US008585018B2

(12) United States Patent
Seber et al.

(10) Patent No.: US 8,585,018 B2
(45) Date of Patent: Nov. 19, 2013

(54) RATCHETING JACK STAND

(75) Inventors: Brett P. Seber, Vista, CA (US); Wesley James Tom, Vista, CA (US)

(73) Assignee: Seber Design Group, Inc., Vista, CA (US)

( * ) Notice: Subject to any disclaimer, the term of this patent is extended or adjusted under 35 U.S.C. 154(b) by 700 days.

(21) Appl. No.: 12/369,598

(22) Filed: Feb. 11, 2009

(65) Prior Publication Data

US 2009/0200528 A1 Aug. 13, 2009

Related U.S. Application Data

(60) Provisional application No. 61/027,587, filed on Feb. 11, 2008.

(51) Int. Cl.

| | |
|---|---|
| ***B66F 7/10*** | (2006.01) |
| ***B66F 3/08*** | (2006.01) |
| ***B66F 1/04*** | (2006.01) |
| ***B66F 3/00*** | (2006.01) |
| ***A47F 5/00*** | (2006.01) |

(52) U.S. Cl.
USPC ..... 254/131; 254/89 H; 254/98; 254/108; 248/352; 248/351

(58) Field of Classification Search
USPC ..... 248/352, 351; 254/98, 89 H, 108, 131
See application file for complete search history.

(56) References Cited

U.S. PATENT DOCUMENTS

| | | | | |
|---|---|---|---|---|
| 1,175,211 | A * | 3/1916 | Willour | 254/110 |
| 1,394,263 | A * | 10/1921 | Adell | 254/111 |
| 1,524,751 | A | 2/1925 | Ryder | |
| 1,607,373 | A | 11/1926 | Trundle, Jr. | |
| 1,741,343 | A * | 12/1929 | Smith et al. | 254/111 |
| 2,193,424 | A * | 3/1940 | Johnson | 254/111 |
| 3,737,146 | A * | 6/1973 | Potter et al. | 254/108 |
| 4,856,618 | A * | 8/1989 | Isogai | 187/208 |
| 5,180,131 | A * | 1/1993 | Few | 248/352 |
| 6,691,983 | B2 * | 2/2004 | Arzouman | 254/1 |
| 2006/0186387 | A1 * | 8/2006 | Lu | 254/108 |

OTHER PUBLICATIONS

EPO Office Action dated Mar. 5, 2012, EPO Application No. 09 710 579.5.
Chinese Office Action dated Apr. 22, 2013, Chinese Patent Application No. 200980112755.8.

* cited by examiner

*Primary Examiner* — Monica Carter
*Assistant Examiner* — Seahee Yoon
(74) *Attorney, Agent, or Firm* — Patterson & Sheridan, L.L.P.

(57) ABSTRACT

Aspects of the disclosure include a jack stand. The stand may include one or more of: a housing, elongated support, engagement element, engagement element receiver, and a modulator. The housing may be adapted for receiving the elongated support. The elongated support may be configured for being associated with the housing, and may include one or more, e.g., a plurality of engagement element receivers. The plurality of receivers may be positioned sequentially along a length of the support and may be configured for receiving a portion an engagement element. The engagement element, therefore, may be adapted for removably engaging the engagement element receivers in sequential fashion, wherein the sequential engagement of the engagement element receivers by the engagement element causes the elongated support to move. The modulator may be associated to the engagement element and configured for modulating the engagement of the engagement element with the plurality of receivers.

8 Claims, 4 Drawing Sheets

RATCHETING JACK STAND

CROSS REFERENCE TO RELATED APPLICATIONS

The present application claims priority under 35 U.S.C. §119 to U.S. Provisional Application Ser. No. 61/027,587, filed Feb. 11, 2008, entitled RATCHETING JACK STAND, the disclosure of which is incorporated herein by reference.

BACKGROUND OF THE DISCLOSURE

The present disclosure generally relates to a jack stand, such as a jack stand having a modulating mechanism (e.g., a modulator). For instance, in certain embodiments, the jack stand includes a ratcheting mechanism and may, therefore, be termed a ratcheting jack stand. For example, the present disclosure relates to a jack stand that integrates an engagement element, such as an engageable pawl and/or a release button for sequentially engaging a plurality of engagement element receivers, e.g., pawl receiver, for easily manipulating the vertical height of an elongated support, such as a central shaft, in the jack stand.

Jack stands have been utilized for many years to support or raise large loads. For instance, jack stands may be used to lift equipment for ramps, raise an automobile to be repaired, or to raise and stabilize other devices to gain access to difficult to reach places under the device. The jack stand must be able to safely support and lift heavy loads and other heavy equipment. Conventional jack stands have been used for this purpose. For example, jack stands are commonly placed under the frame or axle of a vehicle to be raised.

For this purpose, jack stands typically include a support, such as a central shaft, that is extendable from within the jack stand and is capable of being raised to a designated height and locked in place. The jack stand maintains the vehicle in this raised position until work is completed. Easy adjustability and positive locking of the jack stand at desired heights are important features of a jack stand. Moreover, the strength and stability of the jack stand are also features important to ensuring maximum safety while maintaining such heavy loads in elevated positions.

Conventional jack stands have a strong stable base typically formed from a strong material such as steel. A support or shaft central to the base extends out and above the base. The central shaft may also include a platform for stabilizing the lifted load. Accordingly, the lifted load rests against the platform when the central shaft is extended out from the base. The height of the central shaft, extending beyond the top of the base, along with the height of the base itself, determines the height at which the load is to be maintained.

In general, there are two mechanisms for maintaining the lifted load on the platform and at a desired height. In one mechanism, the jack stand receives a pin inserted through a plurality of holes drilled through the base and the central shaft. The holes in the central shaft are placed intermittently along the length of the shaft thereof. The jack stand mechanically raises the central shaft whereupon reaching the approximate desired height, a pin is inserted through a hole in one side of the base, through a corresponding hole in the central shaft and out another hole on an opposite side of the base.

The inserted pin maintains the central shaft at the desired elevated height above the base. The pin should be inserted through both sides of the base to prevent inadvertent withdrawal of the pin therefrom. One danger from an inadequately inserted pin is that the jack stand slips. Thus, an improperly inserted pin may not adequately hold the central shaft in place. Further, one cumbersome aspect of this pin design is that it is necessary to remove and reinsert the pin in the jack stand when altering the height of the central shaft.

Additionally, while the pin is a generally acceptable way to maintain the jack stand in an elevated position, it does have several drawbacks. For instance, some jack stands incorporate a locking element that prevents the pin from withdrawing from the holes in the base and the corresponding hole in the central shaft. The locking element slides through a hole formed through the width of the pin. The locking element is greater than the width of the holes the pin is inserted into to prevent the pin from sliding out of the holes. Commonly, users may intentionally fail to insert the locking element for the sake of convenience and speed. Moreover, the pin or the locking element may be easily misplaced when removed form the jack stand. The jack stand is thereafter completely inoperable until at least the pin is found. Aligning the pin with the holes in the base and central shaft of the jack stand can also be difficult. The weight of the central shaft can cause the pin to slip out of alignment before the pin is inserted through the central shaft and out other side of the jack stand base. Any slippage of the central shaft can cause injury to the person operating the jack stand.

Another jack stand design includes a central shaft having a plurality of teeth formed on one edge that engage a pawl attached to an external handle. This mechanism does not require any removable parts to engage or disengage the pawl to the teeth on the central shaft or to hold the platform at a desired height. But, in some designs, the handle that operates the pawl can be easily moved such that the pawl may accidentally disengage from the teeth on the central shaft. For example, the weight of the corresponding handle biases the pawl against the teeth of the central shaft. Simply applying enough force to rotate the handle against its own weight, typically a relatively moderate force, can disengage the pawl from the teeth in the central shaft. It is highly possible, therefore, to inadvertently jostle the handle while the jack stand is under load. The central shaft, and corresponding platform holding the load, may quickly fall when the pawl disengages the central shaft. Disengagement of the pawl from the central shaft, when under heavy loads, can certainly damage the jack stand, the load being maintained thereby, as well as the jack stand operator and nearby equipment. Further, such jack stand designs do not typically provide a means for easily disengaging the pawl from the central shaft.

Thus, there is a need in the art for a jack stand that is automatically engageable with a central shaft and/or a jack stand that can be easily disengaged therefrom to manipulate the height of the central shaft. Such a jack stand may include a ratcheting mechanism having an engagement element, such as a pawl that is capable of automatically engaging an engagement element receiver, e.g., a pawl receiver, and/or remaining engaged therewith for maintaining the height of the central shaft of the jack stand. In certain embodiments, the jack stand may include an exterior release button that easily disengages the engagement element, e.g., pawl, from a complementary receiver positioned on the central shaft. The present invention fulfills these needs and provides further related advantages.

SUMMARY OF THE DISCLOSURE

The present disclosure for a jack stand generally includes a housing which housing may form a base for the jack stand. Also included may be a support, such as a central shaft. The housing may be adapted for receiving the central shaft there through. The central shaft may be configured for being moved within the housing. For instance, in certain embodiments, the central shaft is extendable or retractable with respect to the housing. For example, in certain embodiments, the jack stand includes a modulating mechanism or modulator, such as a ratcheting mechanism, for automatically moving the central shaft with respect to the housing. Specifically, in certain embodiments, a ratcheting mechanism is disposed within a collar of the jack stand and employed so as to raise the central shaft with respect to the housing, e.g., base.

In certain instances, the ratcheting mechanism includes a lever, which lever may be rigidly attached to a lifting arm. The lifting arm may include a spring-loaded engagement element, such as a finger, that engages any one of a plurality of engagement element receivers, or slots, formed in a side of the central shaft. Accordingly, rotation of a corresponding lever may cause the engagement of the engagement element, e.g., spring-loaded finger, with the engagement element receiver, e.g., slot, such that the central shaft is lifted upwardly with respect to the base. The ratcheting mechanism may further include an additional engagement element, such as a pawl, which engagement element is rotationally mounted to an axis member, such as a horizontal axis member, that interconnects the lever to the lifting arm. The pawl is free to rotate relative to the lever and lifting arm.

In certain embodiments, the lifting of the central shaft may be accomplished by rotating the lever arm, e.g., clockwise, to engage the spring-loaded finger with a slot in the central shaft. Continual rotation of the lever arm while the finger is engaged in the slot causes the pawl to start disengaging its respective slot. A spring element may be included, for instance, to continually bias the pawl toward the central shaft while the central shaft is being raised by the lifting arm. The pawl may then reengage another slot, lower than the original slot, once the central shaft travels a vertical distance greater than the distance between individual slots. Accordingly, the pawl is immediately reengaged with the new slot. As set forth above, re-engagement may be further enhanced from the force of a corresponding spring.

In certain embodiments, a release is included. A release may be rigidly coupled to an engagement element, such as a pawl. In such instances, disengagement of the central shaft from the ratcheting mechanism may be effectuated by the depression of the release, which release may be in the form of a button rigidly attached to the pawl. Depression of the release button may cause clockwise rotation of both the release button and the pawl. Such movement may be resisted by a spring element, which spring element may mounted to the housing, such as in a collar of the jack stand housing. Once the pawl is completely disengaged from the slot, the central shaft may be free to move within a channel formed in the housing, such as collar having an opening configured for receiving the moveable shaft there through. Removing the force from the release button may cause the spring in the housing to expand thereby forcing the pawl back into engagement with a slot in the central shaft. The central shaft of the jack stand may there again be locked in place.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION

Figure 1:
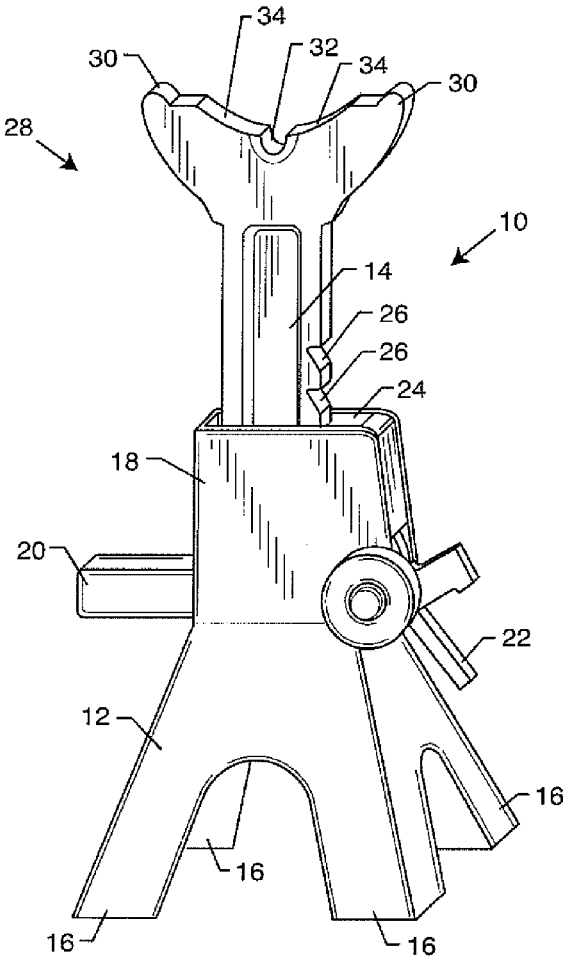
FIG. 1 is a perspective view of a jack stand in accordance with the present invention.

As shown in the drawings for purposes of the illustration, the present invention for a jack stand is generally referred to by the reference number 10. As shown in FIG. 1, the jack stand 10 has a housing, which housing may be configured to include a supportive base 12. The jack stand 10 may further include an elongated support, such as a central shaft 14, which shaft functions for lifting or holding a large load. The supportive base 12 may includes one or more, e.g., a plurality, of feet 16, which feet are adapted for balancing the jack stand 10 when under load. The supportive base 12 may generally taper inwardly from the feet 16 toward a vertically extending portion of the housing, e.g., a collar 18, which collar may house a modulating mechanism or modulator, such as ratcheting mechanism 19 (FIGS. 4-8) of the present disclosure. The ratcheting mechanism 19 is shown in greater detail and in operation in FIGS. 4-8. The base 12, central shaft 14 and collar 18 may be made from hardened steel or other comparable composite material capable of carrying large or heavy loads. External to the collar 18 may be one or more of a lever 20 and a release button 22, which elements may facilitate the operation of the ratcheting mechanism 19. The side views of FIGS. 2 and 3 further illustrate the extension of the lever 20 and the release button 22 from the exterior of the collar 18. Accordingly, the lever 20 is shown in a substantially horizontal resting position in FIGS. 2 and 3. The operation of the lever 20 and the release button 22 are explained in detail below with respect to the ratcheting mechanism 19 of the present disclosure.

The central shaft 14 resides within an opening or channel 24 formed in the collar 18 of the housing of the jack stand 10. In certain embodiments, the central shaft 14 remains within the channel 24 when being moved, e.g., extended, relative to the housing, via the lever 20 and the corresponding ratcheting mechanism 19, and while being retracted, after activation of the release button 22. The central shaft 14 may have one or more, e.g., a plurality, of engagement element receivers, wherein the engagement element receiver(s) may be formed as slots 26 positioned, e.g., sequentially, within the shaft and configured for interoperating with the ratcheting mechanism 19. Moreover, the central shaft 14 may have a cradle 28 shown best in FIGS. 1-3. It will be appreciated that the cradle 28 may include a variety of shapes specifically designed to hold or balance a load therein. In the embodiments shown in FIGS. 1-33 the cradle 28 includes two extensions 30 that generally protrude out from the central shaft 14. These extensions 30 may taper inwardly toward a notch 32, formed there between, along a pair of curved surfaces 34. In this embodiment, the cradle 28 can receive and stably retain a number of different objects along the curved surfaces 34 or within the notch 32. For instance, the curved surfaces 34 may be arched to selectively receive a car axle. The cradle 28 would be extended to the car axle using the ratcheting mechanism 19 described below.

Figure 2:
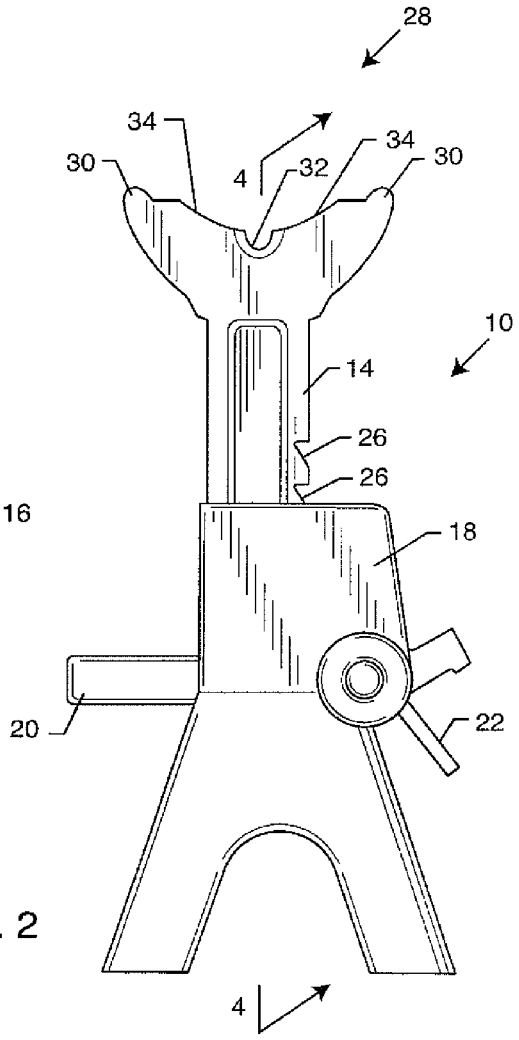
FIG. 2 is a side view of the jack stand of FIG. 1.
Figure 3:
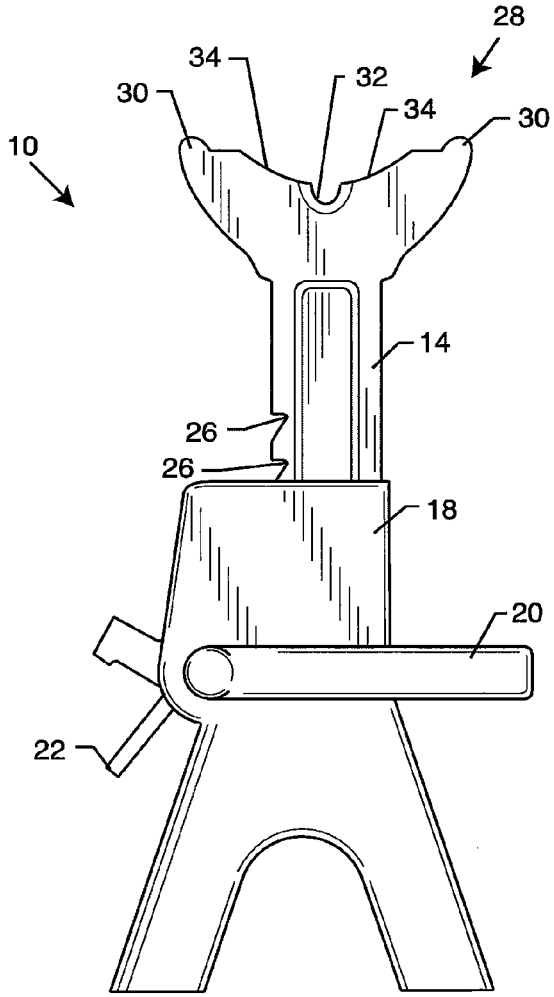
FIG. 3 is an opposite side view of the jack stand of FIG. 2.
Figure 4:
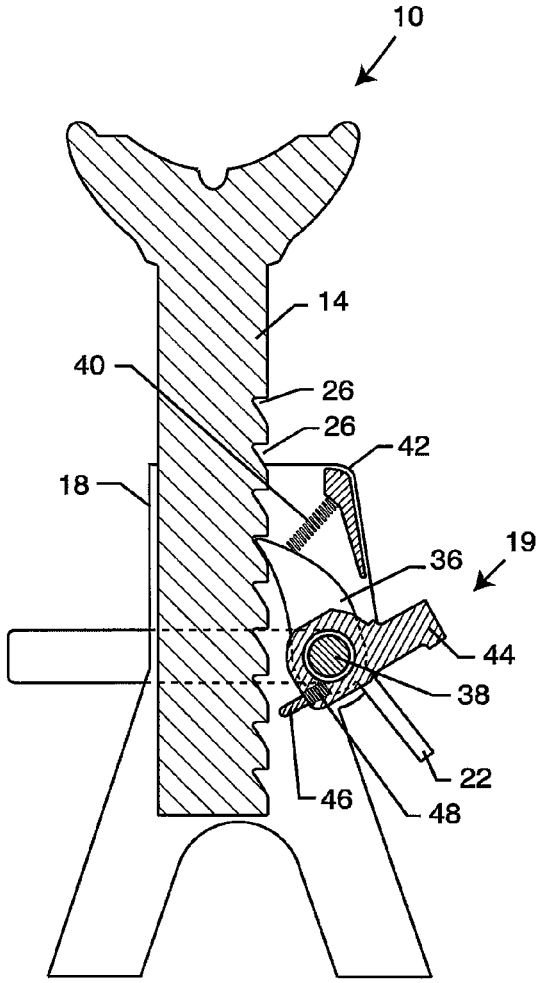
FIG. 4 is partial cross-sectional view taken generally across the line 4-4 of FIG. 2, illustrating the internal ratcheting mechanism.

The modulator or ratcheting mechanism 19 is shown in detail in FIGS. 4-8. In FIG. 4, the ratcheting mechanism 19 has an engagement element configured, for example, as pawl 36, which pawl is adapted to engage any one of the engagement element receivers, e.g., slots, 26 formed in the central shaft 14. The pawl 36 may be rigidly attached to a release button 22 which may extend out from collar 18 as shown in FIGS. 1-3. The combination of the pawl 36 and the release button 22 pivot about a horizontal axis member 38, which axis member is perpendicularly and rigidly attached to the lever 20. A spring element 40 may also be included, wherein the spring element automatically biases the pawl 36 toward engagement with a slot positioned in the central shaft 14. The spring 40 may be a coil spring, as shown in FIGS. 4-8. The spring 40 may securely attach to a housing 42 formed as part of the collar 18. Accordingly, the spring 40 may function to keep pressure between the housing 42 and the pawl 36 so as to keep the pawl 36 automatically biased against the central shaft 14.

The ratcheting mechanism 19 may further include a lifting arm 44. The lifting arm 44 may house an engagement element, such as a finger member 46. The finger member 46 may be biased outwardly by a spring element 48. The finger 46 may be a generally flat piece of reinforced steel with a width comparable to the width of the central shaft 14 so as to ensure full engagement with the slots 26. The finger 46 may be configured so as to be strong enough to lift a heavy object such as an axle of a car. The lifting arm 44 may be rigidly attached to the axis 38 and the corresponding lever 20. Accordingly rotation of the lever 20 causes rotation of the axis 38, the lifting arm 44 and the corresponding finger 46. The combination of the finger 46 and the spring 48 facilitate lifting of the central shaft 14 via engagement with a slot 26 from movement of the lever 20.

Figure 5:
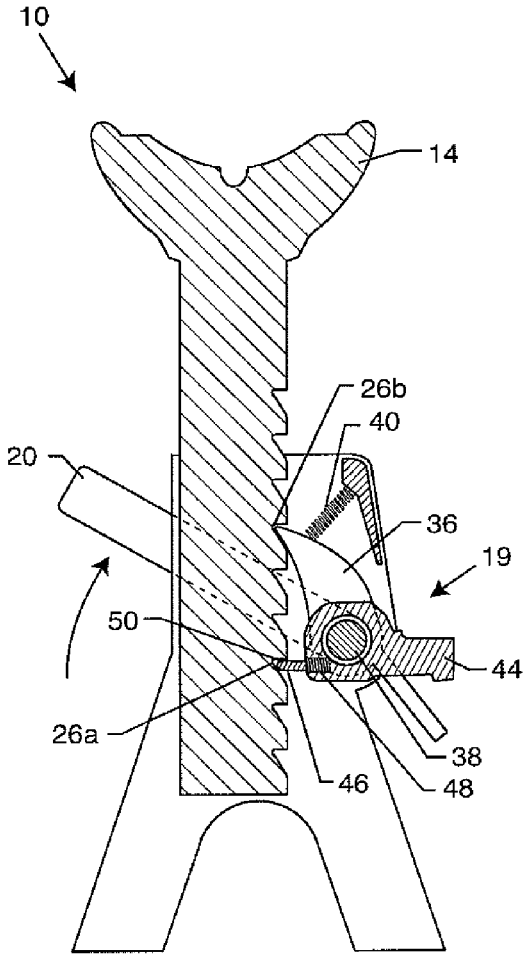
FIG. 5 is an alternative partial cross-sectional view of FIG. 4, illustrating engagement of a spring-loaded lift arm with a central shaft of the jack stand.

FIG. 5 illustrates the initial movement of the ratcheting mechanism 19 in order to lift the central shaft 14. As shown in the side view, the lever 20 may be rotated, e.g., clockwise, along the directional arrow. This clockwise movement causes simultaneous clockwise movement of the rigidly attached lifting arm 44. The finger 46 engages the slot 26*a*. A planar base side 50 of the slot 26*a* initially engages the generally planar finger 46. The finger 46 continues to move into the slot 26*a* and compresses the spring 48 against the body of the lifting arm 44. The spring 48 ensures that the finger 46 remains engaged within the slot 26*a* during the lift and prevents binding of the lifting arm 44 with the central shaft 14. Accordingly, the finger 46 is capable of extending from and/or contracting into the lifting arm 44 via the spring 48, depending on the relative positioning of the finger 46 relative to the slot 26*a* of the central shaft 14. The pawl 36 remains tightly engaged with another slot 26*b* as biased into such an engagement position by the spring 40. The pawl 36 rotates freely about the axis 38 such that the pawl 36 does not rotate when the lever 20 is rotated. In other words, the pawl 36 is not rigidly attached to the lever 20 like the lifting arm 44.

Figure 6:
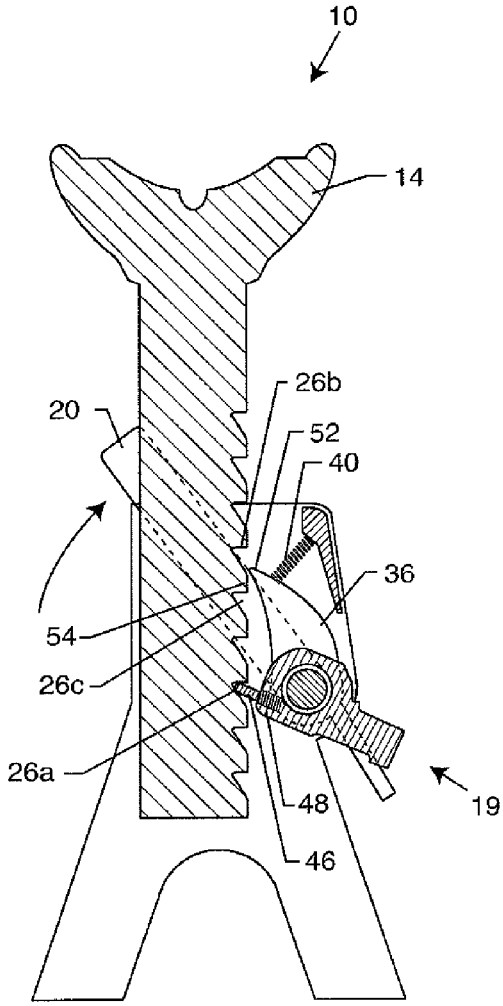
FIG. 6 is another alternative partial cross-sectional view of FIG. 4, illustrating lifting the central shaft with the spring-loaded lift arm and a corresponding lever.

FIG. 6 illustrates further rotation of the lever 20. In this embodiment, the finger 46 of the lifting arm 44 is still tightly engaged with the slot 26*a* as the central shaft 14 is being raised. Here, the spring 48 expands to maintain secure engagement of the finger 46 in the slot 26*a* as the slot 26*a* moves upward with the central shaft 14 and away from the finger 46. As the central shaft 14 moves upwardly, the pawl 36 slips out of its respective slot 26*b* as shown in FIG. 6. The spring 40 continues to bias a head 52 of the pawl 36 against a longitudinal side 54 of the central shaft 14. The head 52 will simply slide against this longitudinal side 54 until reengaging with the slot 26*c*. The pawl 36 locks into the slot 26*c* once the central shaft 14 has been raised high enough to allow the head 52 to slide therein.

Figure 7:
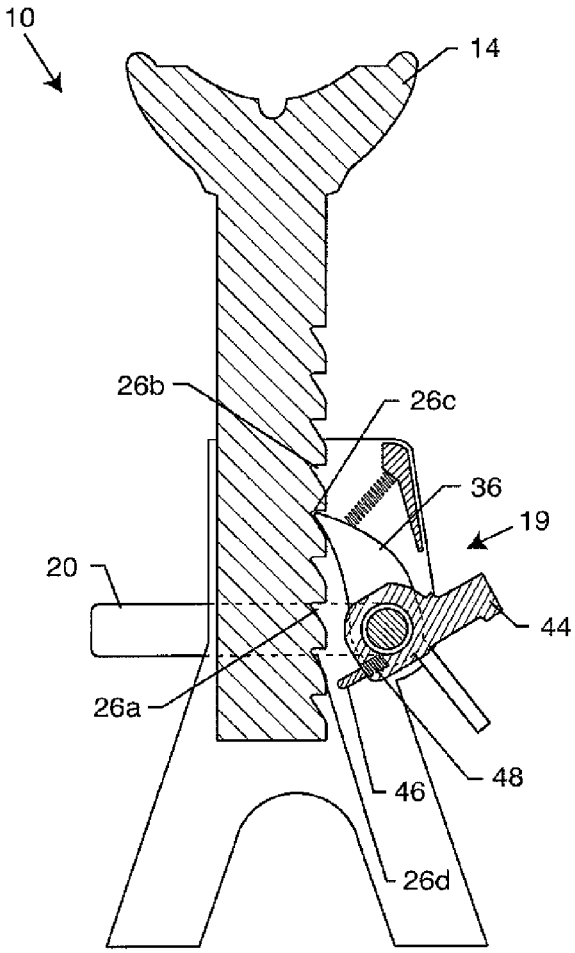
FIG. 7 is another alternative partial cross-sectional view of FIG. 4, illustrating reengagement of a pawl with a notch in the central shaft.

FIG. 7 illustrates engagement of the pawl 36 within the slot 26*c* of the central shaft 14. As shown, the slot 26*c* is located one slot above the slot 26*b*. Hence, the central shaft 14 has been effectively raised by one slot 26 or by one "stroke". In this embodiment, the lever 20 is returned to the substantially horizontal resting position shown previously in FIG. 4. Accordingly, the lifting arm 44 is in a non-engaged position such that the finger 46 is no longer engaged to a slot 26, generally. Rotating the lever 20 accordingly to the previously described process would cause engagement of the finger 46 with slot 26*d*, not slot 26*c*, since the central shaft 14 was previously raised one slot 26. In this disengaged position, finger 46 is again fully extended outwardly by the spring 48.

Figure 8:
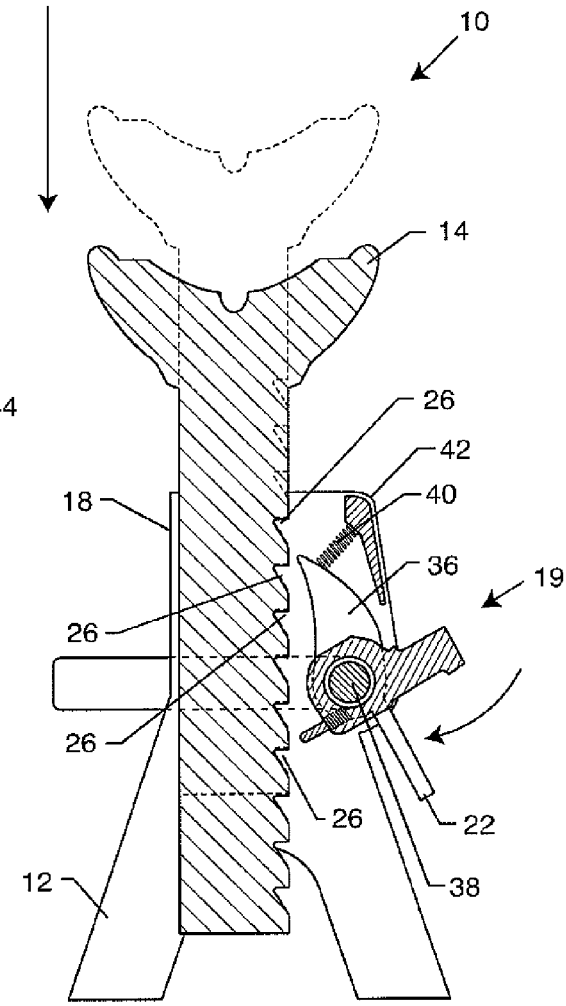
FIG. 8 is another alternative partial cross-sectional view of FIG. 4, illustrating depression of a release button to disengage the pawl from the central shaft.

FIG. 8 generally illustrates releasing the pawl 36 from engagement with the slots 26 to allow the central shaft 14 to be lowered within the jack stand 10. In this embodiment, the release button 22 is depressed along the directional arrow shown in FIG. 8. This depression causes the release button 22 and the rigidly attached pawl 36 to rotate clockwise about the axis 38. Such clockwise rotation causes the pawl 36 to disengage from the slots 26. Enough force must be exerted on the release button 22 to compress the spring 40 into the housing 42 of the collar 18. Upon complete disengagement of the pawl 36 and the corresponding head 52 from the slots 26, the central shaft 14 is free to move vertically within the channel 24. The base 12 may have an aperture formed therein (not shown) such that the central shaft 14 may drop below the collar 18 as shown in FIG. 8. The pawl 36 automatically reengages a corresponding slot 26 when the rotational pressure placed on the release button 22 along the directional arrow in FIG. 8 is released.

Although an embodiment of the disclosure has been described in detail for purposes of illustration, various modifications may be made without departing from the scope and spirit of the devices disclosed herein.

What is claimed is:

1. A jack stand, comprising:

a housing;

an elongated support having a plurality of engagement element receivers; and a modulator comprising a first engagement element including a finger and a first spring element outwardly biasing the finger and a second engagement element biased towards the engagement element receivers by a second spring element, wherein the first engagement element is configured to move the elongated support relative to the housing and both engagement elements are independently rotatable about a single point.

2. The jack stand of claim 1, wherein the elongated support is at least partially positioned within the housing.

3. The jack stand of claim 1, wherein the single point is a horizontal axis member.

4. The jack stand of claim 3, wherein the first engagement element is rigidly coupled to the horizontal axis member.

5. The jack stand of claim 3, wherein a lever is rigidly coupled to the horizontal axis member.

6. The jack stand of claim 5, wherein rotational movement of the lever results in rotation of the horizontal axis member.

7. The jack stand of claim 1, wherein the second spring element is located in the housing.

8. The jack stand of claim 7, wherein the modulator further includes a release button that is rigidly attached to the second engagement element, wherein when the release button is depressed, the second spring element is compressed, and the second engagement element is disengaged from the engagement element receivers.

* * * * *